US009895905B2

(12) United States Patent
Isozaki et al.

(10) Patent No.: US 9,895,905 B2
(45) Date of Patent: Feb. 20, 2018

(54) DROPLET EJECTION APPARATUS

(71) Applicant: FUJI XEROX CO., LTD., Tokyo (JP)

(72) Inventors: Jun Isozaki, Kanagawa (JP); Akira Sakamoto, Kanagawa (JP); Hiroyuki Tsukuni, Kanagawa (JP); Tomozumi Uesaka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 15/333,252

(22) Filed: Oct. 25, 2016

(65) Prior Publication Data

US 2018/0001665 A1 Jan. 4, 2018

(30) Foreign Application Priority Data

Jun. 29, 2016 (JP) ..... 2016-129336

(51) Int. Cl.
*B41J 2/01* (2006.01)
*B41J 11/00* (2006.01)
*B41J 29/377* (2006.01)

(52) U.S. Cl.
CPC ..... *B41J 11/002* (2013.01); *B41J 2/01* (2013.01); *B41J 29/377* (2013.01)

(58) Field of Classification Search
CPC ..... B41J 11/002; B41J 29/377; B41J 11/007; B41J 2/01
USPC ..... 347/101, 102, 104
See application file for complete search history.

(56) References Cited

U.S. PATENT DOCUMENTS 9,163,876 B2 * 10/2015 Chiwata ..... B41J 11/0015

FOREIGN PATENT DOCUMENTS

| | | |
|---|---|---|
| JP | 2003-145737 | 5/2003 |
| JP | 2005-022194 | 1/2005 |
| JP | 2007-176150 | 7/2007 |
| JP | 2015-147347 | 8/2015 |

OTHER PUBLICATIONS

Abstract and machine translation of JP 2015-147347.
Abstract and machine translation of JP 2007-176150.
Abstract and machine translation of JP 2005-022194.
Abstract and machine translation of JP 2003-145737.

* cited by examiner

*Primary Examiner* — An Do
(74) *Attorney, Agent, or Firm* — Fildes & Outland, P.C.

(57) ABSTRACT

A droplet ejection apparatus includes: a droplet ejection head; an irradiation part that irradiates a recording medium with infrared laser light for evaporating a water content of a droplet landed on the recording medium; a supply part that includes a rectifying part disposed along a conveyance direction of the recording medium and causes the rectifying part to supply, above the recording medium, air flowing toward a downstream side in the conveyance direction of the recording medium; and a vent part that vents at least a part of air flown above the recording medium toward the downstream side in the conveyance direction of the recording medium.

8 Claims, 8 Drawing Sheets

DROPLET EJECTION APPARATUS

CROSS-REFERENCE TO RELATED APPLICATIONS

This application is based on and claims priority under 35 USC 119 from Japanese Patent Application No. 2016-129336, filed on Jun. 29, 2016.

TECHNICAL FIELD

The present invention relates to a droplet ejection apparatus.

SUMMARY

An aspect of the invention provides a droplet ejection apparatus, including:

a droplet ejection head that ejects a droplet onto a recording medium;

an irradiation part that is disposed at a downstream side, in a conveyance direction of the recording medium, of the droplet ejection head, and irradiates the recording medium with infrared laser light for evaporating a water content of a droplet landed on the recording medium;

a supply part that is disposed at an upstream side, in the conveyance direction of the recording medium, of the irradiation part and at the downstream side, in the conveyance direction of the recording medium, of the droplet ejection head, includes a rectifying part disposed along the conveyance direction of the recording medium, and causes the rectifying part to supply, above the recording medium, air flowing toward the downstream side in the conveyance direction of the recording medium; and a vent part that is disposed at the downstream side, in the conveyance direction of the recording medium, of the irradiation part, and vents at least a part of air flown above the recording medium toward the downstream side in the conveyance direction of the recording medium.

BRIEF DESCRIPTION OF THE DRAWINGS

Exemplary embodiments of the present invention will be described in detail based on the following figures, wherein.

DETAILED DESCRIPTION

Exemplary embodiments of the present invention will now be described in detail with reference to the accompanying drawings. For convenience of description, in each drawing referred to below, an arrow UP is defined as an upward direction of an inkjet recording apparatus 10, that is, an example of a droplet ejection apparatus, and an arrow FW is defined as a conveyance direction of continuous paper P, that is, an example of a recording medium. Besides, in the following description, the conveyance direction of the continuous paper P is sometimes simply designated as the "conveyance direction", and an upstream side and a downstream side in the conveyance direction are sometimes simply designated as the "conveyance upstream side" and the "conveyance downstream side", respectively. Furthermore, a direction perpendicular to the conveyance direction of the continuous paper P seen from above (in a plan view) is designated as a "width direction", which is illustrated with an arrow W in FIG. 3 and FIG. 5A.

First Embodiment

Figure 1:
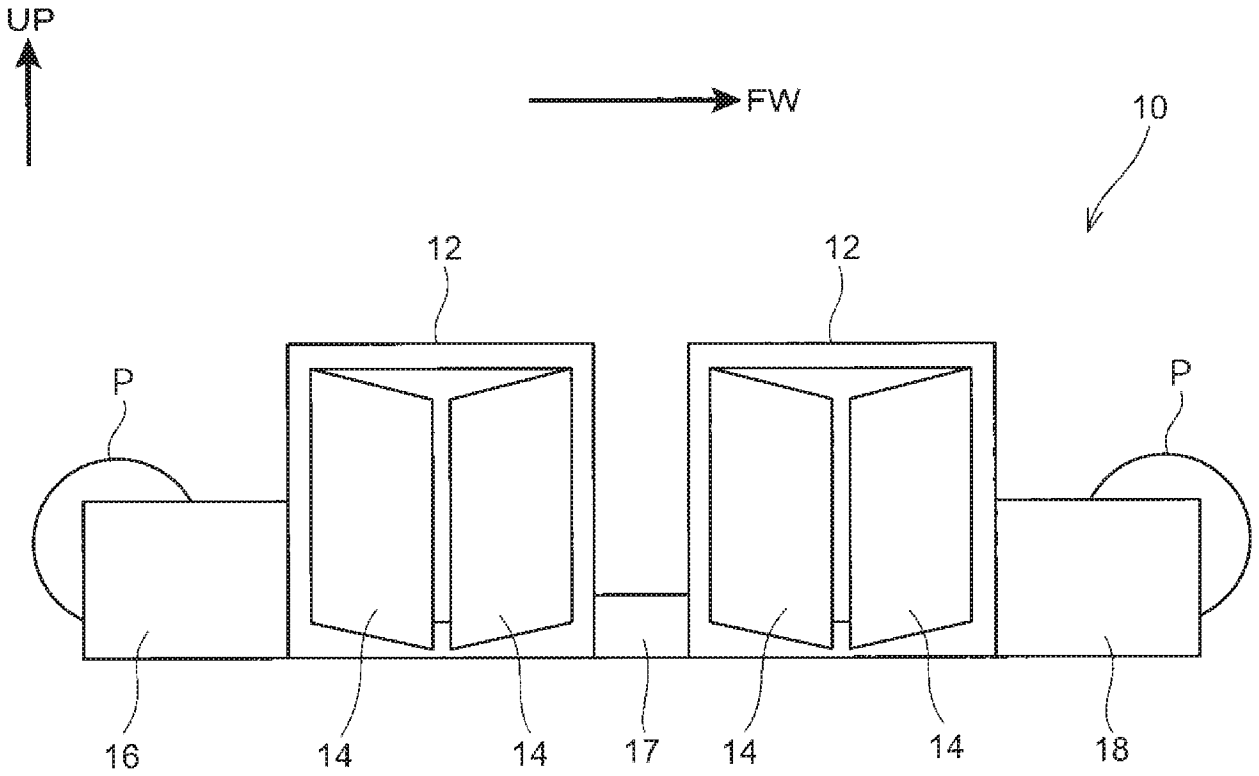
FIG. 1 is a side view illustrating the appearance of an inkjet recording apparatus according to a first embodiment of the present invention.
Figure 2:
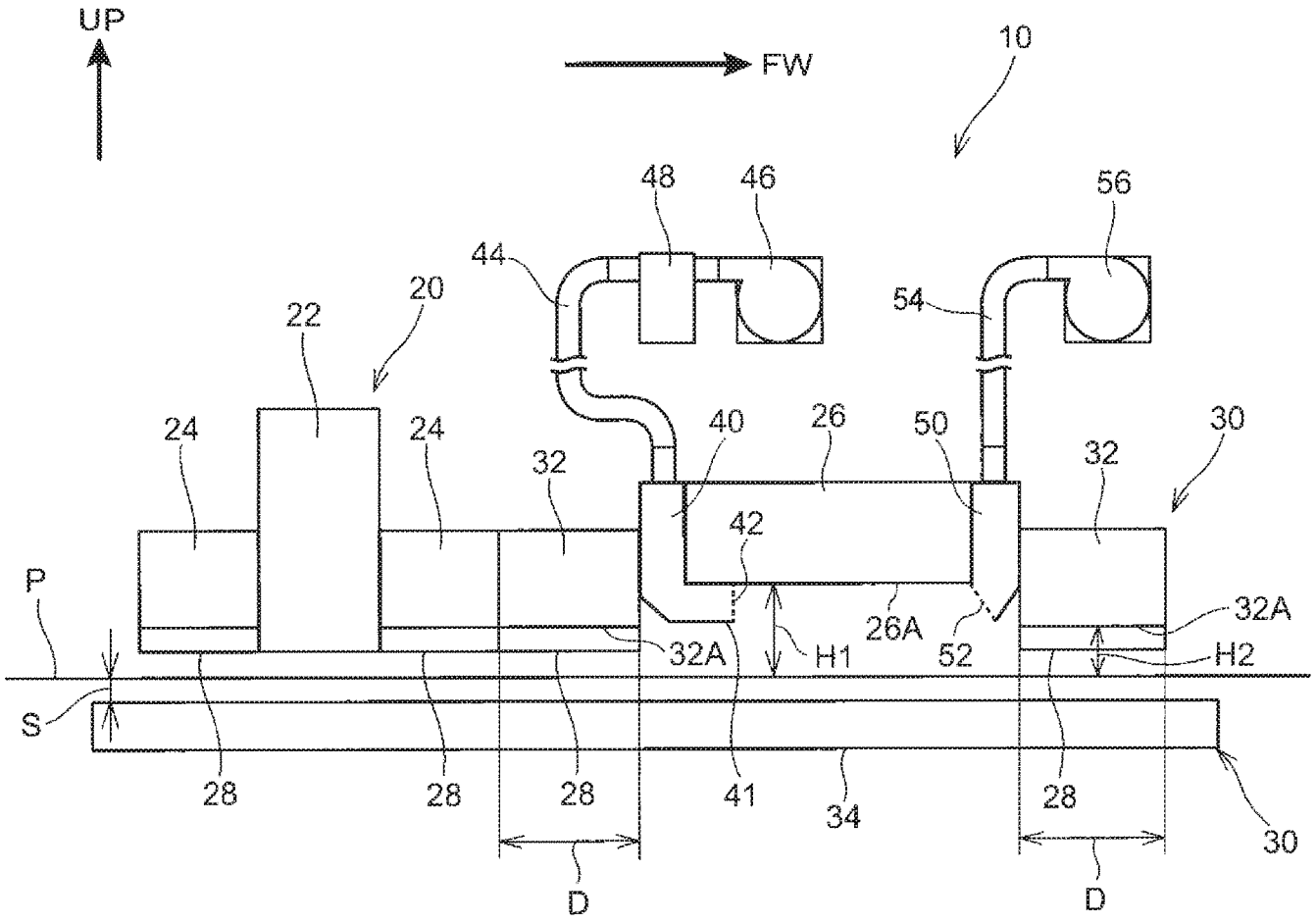
FIG. 2 is a side view illustrating the structure of an image forming part of the inkjet recording apparatus of the first embodiment.

First, an inkjet recording apparatus 10 according to a first embodiment will be described. As illustrated in FIGS. 1 and 2, the inkjet recording apparatus 10 includes an image forming part 20 disposed in a chamber 12. The image forming part 20 is configured by including an inkjet recording head 22, that is, an example of a droplet ejection head that forms an image on an upper surface of continuous paper P by ejecting an ink droplet (a droplet) onto the upper surface of the continuous paper P, an irradiation part 26 that irradiates, with infrared laser light, the continuous paper P on which the ink droplet has landed, a shielding member 30 that inhibits or prevents the infrared laser light from leaking out, and a supply duct 40 and a vent duct 50 that together form, above the continuous paper P, an air flow flowing toward the conveyance downstream side.

As illustrated in FIG. 1, the chamber 12 has an openable door 14, and is configured in such a manner that the irradiation part 26 does not emit infrared laser light if the door 14 is open. Specifically, the chamber 12 is configured by, for example, an interlock mechanism with which the irradiation part 26 is not turned on unless a control part (not illustrated) provided to the inkjet recording apparatus 10 detects a closed state of the door 14.

The continuous paper P rolled up in the form of a roll is disposed in a feeding part 16, so as to be fed from the feeding part 16 into the chamber 12. Then, the continuous paper P printed and discharged from the chamber 12 is wound up in the form of a roll in a winding part 18. Incidentally, in this inkjet recording apparatus 10, two chambers 12 (respectively for a top surface and a bottom surface) are provided so that printing can be performed on both the top and bottom surfaces of the continuous paper P, and a turning part 17 that reverses the continuous paper P is provided between the chamber 12 for the top surface and the chamber 12 for the bottom surface.

Figure 3:
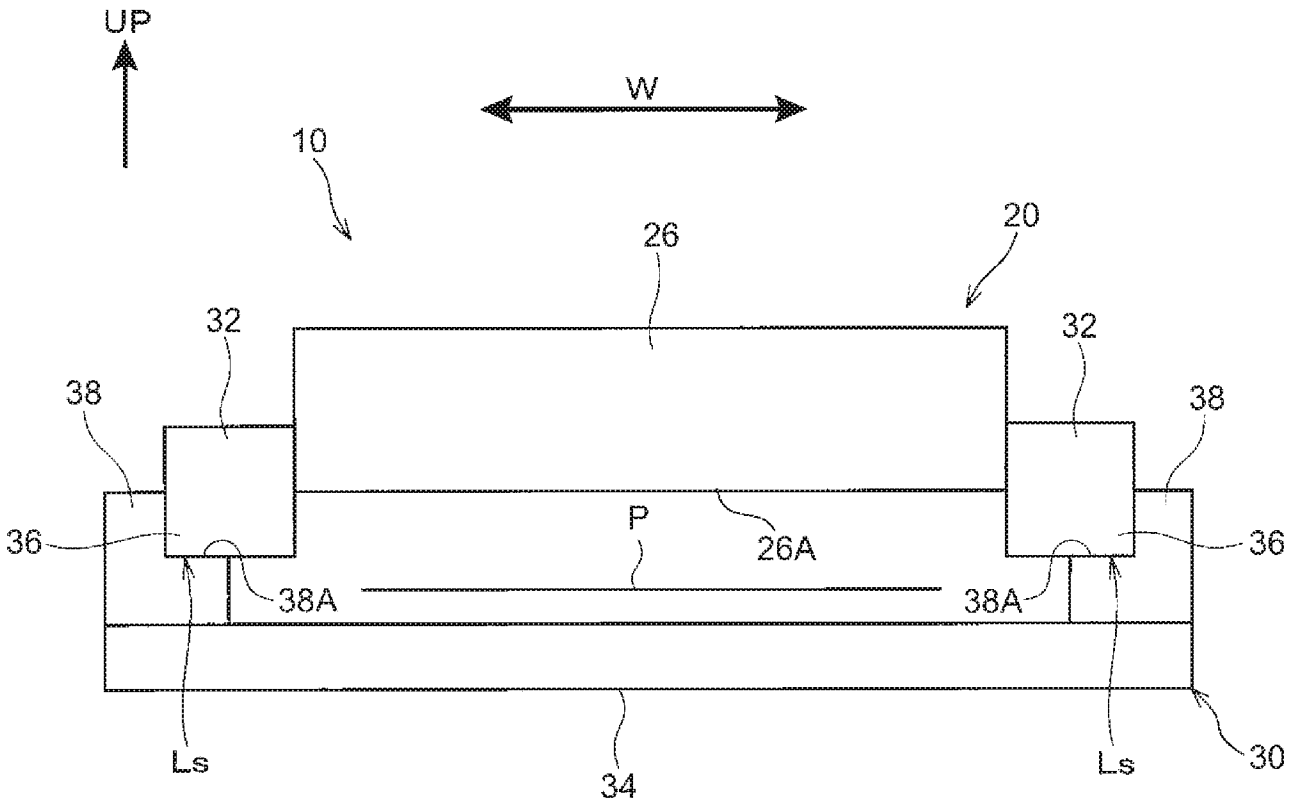
FIG. 3 is a front view illustrating the structure of the image forming part of the inkjet recording apparatus of the first embodiment.

As illustrated in FIGS. 2 and 3, the lengthwise direction of the inkjet recording head 22 accords with the width direction of the continuous paper P, which is conveyed through a conveyance path formed by plural guide rollers (not illustrated) and the like provided within the chamber 12, and the inkjet recording head 22 has a length equal to or larger than the width of the continuous paper P. It is noted that the irradiation part 26 illustrated in FIG. 3 has a widthwise dimension substantially the same as the widthwise dimension of the inkjet recording head 22.

Besides, the inkjet recording head 22 is provided in a plural number in order of colors of black (K), cyan (C), magenta (M) and yellow (Y) from the upstream side in the conveyance direction of the continuous paper P, and the inkjet recording heads 22 of the respective colors successively eject ink droplets of the corresponding colors from above onto the continuous paper P. Incidentally, merely the inkjet recording head 22 of black (K) disposed at the most upstream side in the conveyance direction is illustrated in FIG. 2.

Furthermore, as illustrated in FIG. 2, each inkjet recording head 22 is inserted into and held by a holding member 24 formed in the shape of a rectangular frame, and is disposed above the continuous paper P conveyed through the conveyance path (formed above a lower shielding part 34 included in the shielding member 30). The holding member 24 holding each inkjet recording head 22 is configured to be vertically movable by a known moving mechanism (not illustrated) and to be movable in the width direction of the continuous paper P.

Moreover, at the conveyance downstream side of the inkjet recording head 22 (including the holding member 24), the irradiation part 26 that irradiates, with infrared laser light, the continuous paper P conveyed through the conveyance path (above the lower shielding part 34) is disposed. The irradiation part 26 is configured by a high-power vertical cavity surface emitting laser device capable of emitting laser light of class 4 or higher because it is necessary to dry an ink droplet (namely, evaporate a water content from an ink droplet containing a pigment and water) in an extremely short time of, for example, from several ten milliseconds to several hundred milliseconds.

Around the irradiation part 26, an upper shielding part 32 included in the shielding member 30 is provided. In other words, the irradiation part 26 is inserted into and held by the upper shielding part 32 formed in the shape of a rectangular frame together with the supply duct 40 and the vent duct 50, so as to be disposed above the continuous paper P conveyed through the conveyance path (above the lower shielding part 34).

Owing to the infrared laser light emitted by the irradiation part 26, a water content of an image (an ink droplet) formed on the continuous paper P is evaporated. It is noted that the upper shielding part 32 disposed at the outside in the width direction of the irradiation part 26 forms a fitting portion 36 having a rectangular cross-section as illustrated in FIG. 3.

Besides, a glass plate is provided on a lower surface 26A of the irradiation part 26, and the lower surface 26A (namely, the glass plate) of the irradiation part 26 is disposed at a higher level than a lower surface 32A of the upper shielding part 32 as illustrated in FIG. 2. In other words, a distance H1 between the lower surface 26A of the irradiation part 26 and the upper surface of the continuous paper P is set to be larger than a distance H2 between the lower surface 32A of the upper shielding part 32 and the upper surface of the continuous paper P. Incidentally, the distance H1 is 3 mm to 15 mm, and the distance H2 is 1 mm to 5 mm.

Besides, on the lower surface 32A of the upper shielding part 32 disposed at the conveyance upstream side and the conveyance downstream side of the irradiation part 26, an absorbing part 28 that absorbs the infrared laser light having been reflected on the continuous paper P is provided. More specifically, the lower surface 32A of the upper shielding part 32 disposed on the conveyance upstream side and the conveyance downstream side of the irradiation part 26 is plated with nickel as the absorbing part 28.

Incidentally, the absorbing part 28 (i.e., the upper shielding part 32 disposed at the conveyance upstream side and the conveyance downstream side of the irradiation part 26) has a length D along the conveyance direction of 20 mm or more. Besides, the absorbing part 28 may be provided also on the lower surface of the holding member 24 holding each inkjet recording head 22 so as to absorb the infrared laser light having been reflected on the continuous paper P.

The infrared laser light penetrates, by about several % to 20%, through a white portion of the continuous paper P. Therefore, as illustrated in FIGS. 2 and 3, the lower shielding part 34, which constitutes the shielding member 30 together with the upper shielding part 32, is provided in a position vertically opposing the irradiation part 26 and the upper shielding part 32 with the continuous paper P sandwiched therebetween. An outside portion in the width direction of the lower shielding part 34 (namely, a fit portion 38 described later) has a length along the conveyance direction equal to or larger than a length along the conveyance direction of an outside portion in the width direction of the upper shielding part 32 (namely, the fitting portion 36).

The outside portion in the width direction of the lower shielding part 34 constitutes the fit portion 38 having a substantially L-shaped cross-section with an inside notch 38A, and the fitting portion 36 of the upper shielding part 32 is fit in the notch 38A of the fit portion 38. Thus, the shielding member 30 in the shape of a tunnel through which the continuous paper P can pass in the conveyance direction is formed, and in addition, a labyrinth structure Ls, in which mating surfaces between the fitting portion 36 and the fit portion 38 is formed in a bent shape in a cross-sectional view taken in the conveyance direction, is formed at the outside in the width direction of the continuous paper P (at the outside in the width direction of the shielding member 30).

Although a contact surface between the upper shielding part 32 and the lower shielding part 34 may be a plane, if this labyrinth structure Ls is formed, the infrared laser light is more shielded at least in the width direction of the continuous paper P. Since the absorbing part 28 provided on the lower surface of the upper shielding part 32 disposed at the conveyance upstream side and the conveyance downstream side of the irradiation part 26 absorbs the infrared laser light, the leakage of the infrared laser light toward the upstream side and the downstream side in the conveyance direction of the continuous paper P can be suppressed.

Besides, the upper shielding part 32 is also configured to be vertically movable integrally with the irradiation part 26 by a known moving mechanism (not illustrated), and to be movable in the width direction of the continuous paper P. As the known moving mechanism, for example, a member supporting the upper shielding part 32 integrally with the irradiation part 26 may be driven by an electric motor to be vertically or horizontally moved along a guide rail, but the moving mechanism of the present embodiment is not especially limited.

Furthermore, as illustrated in FIG. 2, a gap S (a vertical gap) is formed between the lower shielding part 34 and the continuous paper P. Specifically, the position of the lower shielding part 34 is set so as to form a gap of about 1 mm to 10 mm in the vertical direction from the continuous paper P, so that the continuous paper P does not come into contact with the lower shielding part 34.

Figure 4:
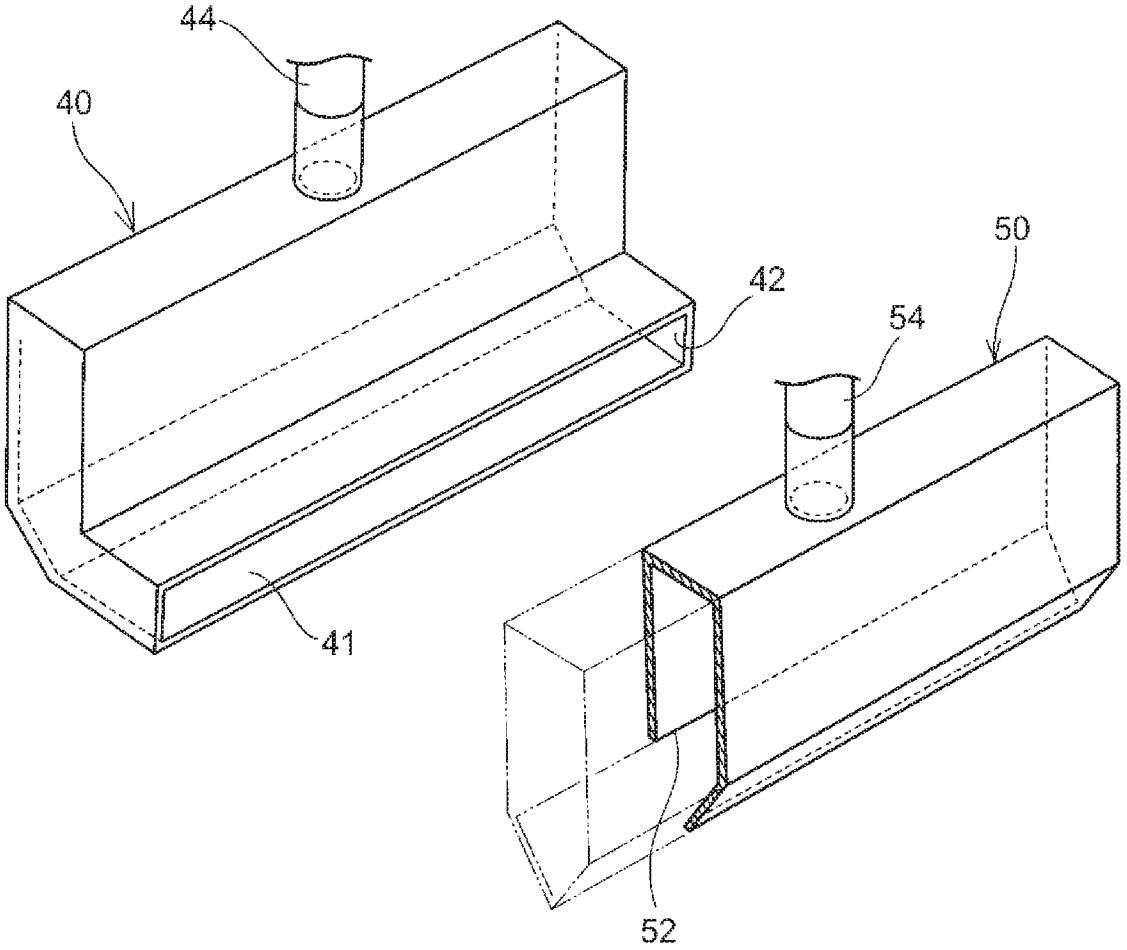
FIG. 4 is a perspective view illustrating the structure of a supply duct and a vent duct of the inkjet recording apparatus of the first embodiment.

As illustrated in FIGS. 2 and 4, at the conveyance downstream side of the inkjet recording head 22 and at the conveyance upstream side of the irradiation part 26 (namely, between the irradiation part 26 and an upstream portion of the upper shielding part 32), the supply duct 40 corresponding to an example of a supply part is provided. In addition, at the conveyance downstream side of the irradiation part 26 (namely, between the irradiation part 26 and a downstream portion of the upper shielding part 32), the vent duct 50 corresponding to an example of a vent part is provided.

A tabular rectifying part 41 having a width equal to or larger than the width of the continuous paper P is disposed along the conveyance direction in a lower end portion of the supply duct 40, and a rectangular outlet 42 opened toward the conveyance downstream side is formed, to include the rectifying part 41, in a lower portion of the supply duct 40. Besides, one end of a flexible tube 44 is connected in a substantially center of an upper end portion of the supply duct 40, and the other end of the flexible tube 44 is connected to an air blower 46.

Accordingly, when the air blower 46 is driven, the supply duct 40 can supply air flowing through the outlet 42 toward the conveyance downstream side (flowing in parallel to the conveyance direction) below the irradiation part 26 and above the continuous paper P. It is noted that a flow rate of the air is set to, for example, 0.02 $m^3$/sec to 0.15 $m^3$/sec per unit length (1 m) in the width direction of the continuous paper P. Besides, a dehumidifying part 48 may be connected to the flexible tube 44 between the supply duct 40 and the air blower 46 so as to blow dry air through the outlet 42.

A rectangular inlet 52 having a width equal to or larger than the width of the continuous paper P (having substantially the same width as the outlet 42) and opened toward the conveyance upstream side is formed in a lower portion of the vent duct 50. One end of a flexible tube 54 is connected in a substantially center of an upper end portion of the vent duct 50, and the other end of the flexible tube 54 is connected to a vent blower 56.

Accordingly, when the vent blower 56 is driven, the vent duct 50 can suck, through the inlet 52, at least a part of the air flown below the irradiation part 26 and above the continuous paper P toward the conveyance downstream side. In other words, the vent duct 50 is configured so that air containing water vapor flown below the irradiation part 26 and above the continuous paper P toward the conveyance downstream side can be vented.

Figure 5A:
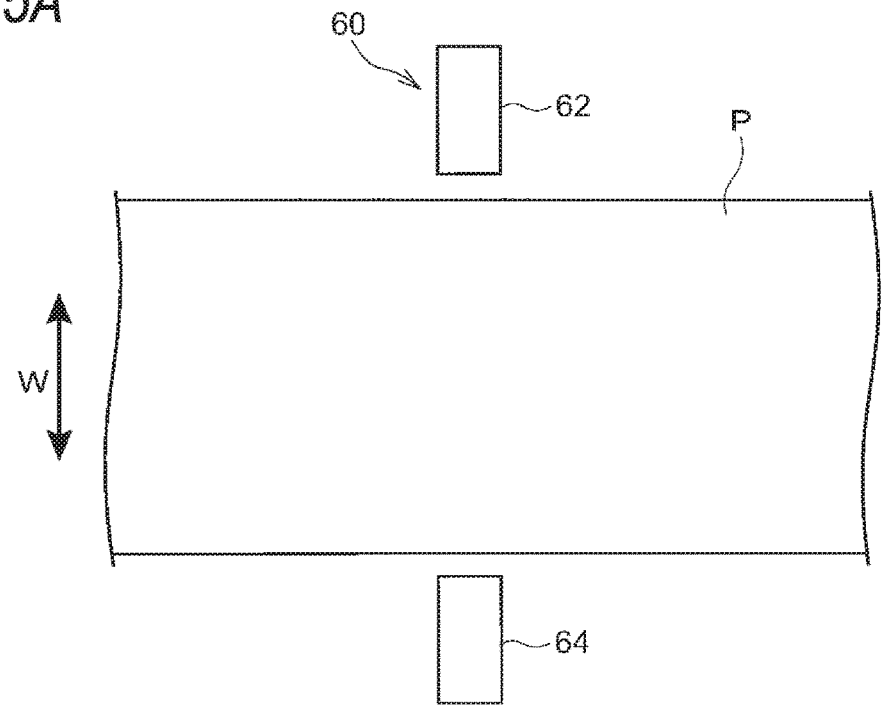
FIG. 5A is a plan view illustrating the structure of a floating detection part of the inkjet recording apparatus of the first embodiment.

Besides, the inkjet recording apparatus 10 includes a floating detection part 60 (see FIG. 5A) for detecting floating of the continuous paper P in a position opposing the irradiation part 26. More specifically, as illustrated in FIG. 5A, a laser emitter 62 is provided at one outside in the width direction of the continuous paper P, and a laser receiver 64 constituting the floating detection part 60 together with the laser emitter 62 is provided at the other outside in the width direction of the continuous paper P.

Figure 5B:
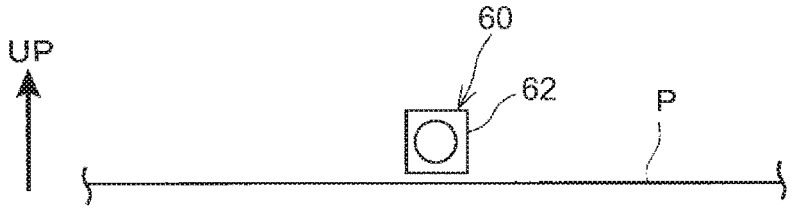
FIG. 5B is a side view illustrating a state where floating of continuous paper is not detected by the floating detection part of the inkjet recording apparatus of the first embodiment.

Here, if floating does not occur in the continuous paper P, laser light emitted from the laser emitter 62 is continuously received by the laser receiver 64 as illustrated in FIG. 5B. In other words, the control part determines that floating has not occurred in the continuous paper P as long as the laser light is received by the laser receiver 64.

Figure 5C:
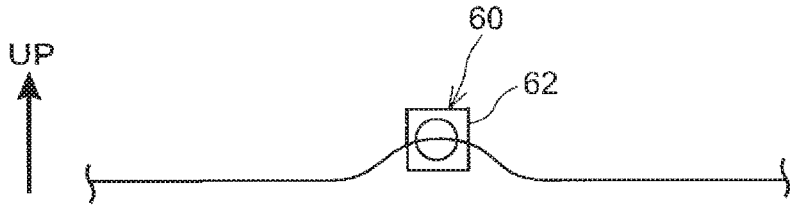
FIG. 5C is a side view illustrating a state where the floating of the continuous paper is detected by the floating detection part of the inkjet recording apparatus of the first embodiment.

On the other hand, if floating occurs in the continuous paper P, the laser light emitted by the laser emitter 62 is prevented by the continuous paper P from being received by the laser receiver 64 as illustrated in FIG. 5C. In other words, since the laser light is not received by the laser receiver 64, the control part determines that floating has occurred in the continuous paper P.

If floating has occurred in the continuous paper P, the control part determines that a pressure in a space between the lower surface 26A of the irradiation part 26 and the upper surface of the continuous paper P is negative, and therefore, on the basis of this determination, the control part adjusts the flow rate of the air blown through the outlet 42 of the supply duct 40 or the flow rate of the air sucked (vented) through the inlet 52 of the vent duct 50.

In other words, the control part adjusts driving or the like of the air blower 46 and the vent blower 56 so that the flow rate of the air blown through the outlet 42 of the supply duct 40 can be equal to or higher than the flow rate of the air sucked (vented) through the inlet 52 of the vent duct 50. Thus, the pressure in the space between the lower surface 26A of the irradiation part 26 and the upper surface of the continuous paper P is set to be positive.

Figure 6:
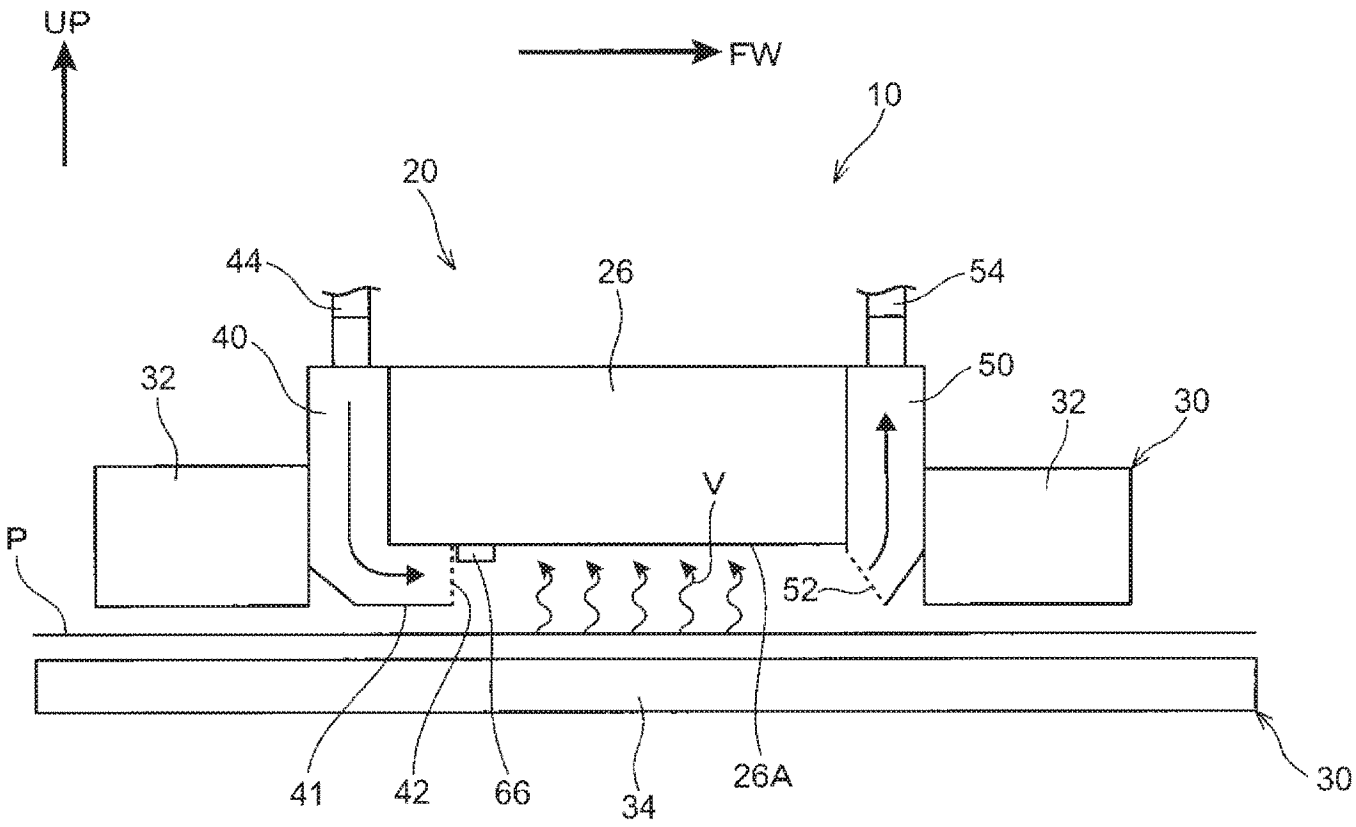
FIG. 6 is a side view illustrating the structure of the image forming part including a pressure sensor of the inkjet recording apparatus of the first embodiment.

Incidentally, as illustrated in FIG. 6 (it is noted that the absorbing part 28 is omitted in FIGS. 6 to 8), a pressure sensor 66, that is, an example of a pressure detection part for detecting the pressure in the space between the lower surface 26A of the irradiation part 26 and the upper surface of the continuous paper P, may be provided in an end portion (a portion not obstructing the irradiation with the infrared laser light) on the lower surface 26A of the irradiation part 26.

Specifically, on the basis of a detection result obtained by the pressure sensor 66, the control part may adjust the flow rate of the air blown through the outlet 42 of the supply duct 40 or the flow rate of the air sucked (vented) through the inlet 52 of the vent duct 50, so that the pressure in the space between the lower surface 26A of the irradiation part 26 and the upper surface of the continuous paper P can be positive.

The inkjet recording apparatus 10 of the first embodiment having the aforementioned configuration works as follows.

If a print job is executed in the inkjet recording apparatus 10, an ink droplet is ejected from each inkjet recording head 22 in each chamber 12 onto the continuous paper P fed from the feeding part 16. Thus, an image is formed on the upper surface of the continuous paper P (or both the top and bottom surfaces of the continuous paper P).

When an image is formed on the continuous paper P in each chamber 12, the continuous paper P is irradiated with infrared laser light by the irradiation part 26. Thus, the temperature of a water content contained in the image formed on the upper surface of the continuous paper P, namely, contained in the ink droplet, is increased instantly (in several ten milliseconds to several hundred milliseconds), and the water content of the ink droplet is evaporated. Accordingly, ink bleeding otherwise caused by a water content penetrating into the continuous paper P can be reduced, and in addition, an optical density of the image can be suppressed or prevented from lowering.

In particular, the irradiation part 26 is disposed above the conveyance path so that the continuous paper P can be irradiated with the infrared laser light in the normal direction in a side view taken from the width direction of the continuous paper P. Therefore, as compared with a structure in which the irradiation part 26 irradiates, with the infrared laser light, from above obliquely to the normal direction of the continuous paper P, the evaporation of the water content from the image (the ink droplet) formed on the upper surface of the continuous paper P is accelerated.

Besides, at the outside in the width direction of the irradiation part 26, the fitting portion 36 of the upper shielding part 32 and the fit portion 38 of the lower shielding part 34 are mutually fit. In other words, at the outside in the width direction of the irradiation part 26, the labyrinth structure Ls is formed by the mating surfaces between the fitting portion 36 and the fit portion 38. Accordingly, as compared with a case where the labyrinth structure Ls is not formed at the outside in the width direction of the irradiation part 26, the infrared laser light can be suppressed or prevented from leaking to the outside in the width direction.

Besides, on the lower surface 32A of the upper shielding part 32 disposed at the conveyance upstream side and the conveyance downstream side of the irradiation part 26, the absorbing part 28 having a length D, along the conveyance direction, of 20 mm or more is provided. Accordingly, the infrared laser light reflected on the upper surface of the continuous paper P is absorbed by the absorbing part 28. Therefore, as compared with a case where the absorbing part 28 is not provided on the lower surface 32A of the upper shielding part 32 disposed at the conveyance upstream side and the conveyance downstream side of the irradiation part 26, the infrared laser light can be suppressed from leaking beyond the shielding member 30 (the upper shielding part 32) toward the conveyance upstream side and the conveyance downstream side.

Furthermore, the gap S is formed between the continuous paper P and the lower shielding part 34. In other words, the lower surface of the continuous paper P is not in contact with an upper surface 34A of the lower shielding part 34. Accordingly, as compared with a structure in which the lower surface of the continuous paper P is in contact with the upper surface 34A of the lower shielding part 34, heat of an ink droplet heated by the infrared laser light is prevented from leaking from the continuous paper P to the lower shielding part 34. As a result, an ink droplet landed on the upper surface of the continuous paper P is efficiently heated, so that the evaporation of a water content of the ink droplet can be accelerated (namely, the efficiency of drying the ink droplet can be improved).

Here, below the irradiation part 26 and above the continuous paper P, the air flow flowing toward the conveyance downstream side is formed by the supply duct 40 and the vent duct 50. Accordingly, the water content evaporating from the ink droplet, namely, water vapor V (see FIG. 6) coming up from the upper surface of the continuous paper P, is forcedly conveyed toward the conveyance downstream side by the air flow, so as to be sucked (collected) to be vented by the vent duct 50.

In particular, since the lower surface 26A of the irradiation part 26 is disposed at the higher level than the lower surface 32A of the upper shielding part 32, as compared with a case where the lower surface 26A of the irradiation part 26 and the lower surface 32A of the upper shielding part 32 are disposed at the same level, the air containing the water vapor V is inhibited from flowing below the upper shielding part 32 toward the conveyance downstream side. In other words, the air containing the water vapor V is easily sucked (collected) by the vent duct 50.

Accordingly, the water vapor V is inhibited from staying above the continuous paper P without being sucked (collected), so as to be inhibited or prevented from adhering again to the upper surface of the continuous paper P. Thus, the water vapor V is prevented from adhering (condensing into dew) on the lower surface 26A (the glass plate) of the irradiation part 26 or the like.

When the lower surface 26A of the irradiation part 26 is disposed at the higher level than the lower surface 32A of the upper shielding part 32, even if the continuous paper P has floated, an ink droplet landed on the upper surface of the continuous paper P can be inhibited or prevented from adhering to the lower surface 26A (the glass plate) of the irradiation part 26, and this inkjet recording apparatus 10 is provided with the floating detection part 60 or the pressure sensor 66.

Accordingly, the flow rate of the air blown through the outlet 42 of the supply duct 40 or the flow rate of the air sucked (vented) through the inlet 52 of the vent duct 50 is adjusted by the control part so that the pressure in the space between the lower surface 26A of the irradiation part 26 and the upper surface of the continuous paper P can be positive. Therefore, the occurrence of floating of the continuous paper P is inhibited or prevented.

Furthermore, the air blown through the outlet 42 of the supply duct 40 is caused to flow substantially in parallel to the conveyance direction by the rectifying part 41 included in the outlet 42. Therefore, for example, as compared with a case where the air is blown toward the upper surface of the continuous paper P, an ink droplet landed but not dried on the upper surface of the continuous paper P is inhibited or prevented from shifting in position.

Besides, since the upper shielding part 32 is constituted to be movable in the vertical and width directions integrally with the irradiation part 26, as compared with a case where the upper shielding part 32 is fixed together with the irradiation part 26, the maintenance of the irradiation part 26 is easily performed, and the maintenance of the upper shielding part 32 and the lower shielding part 34 is easily performed.

Furthermore, since the inkjet recording apparatus 10 includes the interlock mechanism with which the irradiation part 26 does not emit infrared laser light unless the door 14 of the chamber 12 is closed, as compared with a case where such an interlock mechanism is not included, the infrared laser light is prevented from leaking out of the chamber 12.

Second Embodiment

An inkjet recording apparatus 10 according to a second embodiment of the present invention will now be described. It is noted that like reference signs are used to refer to like elements used in the first embodiment, so as to omit the detailed description (including the common effects).

Figure 7:
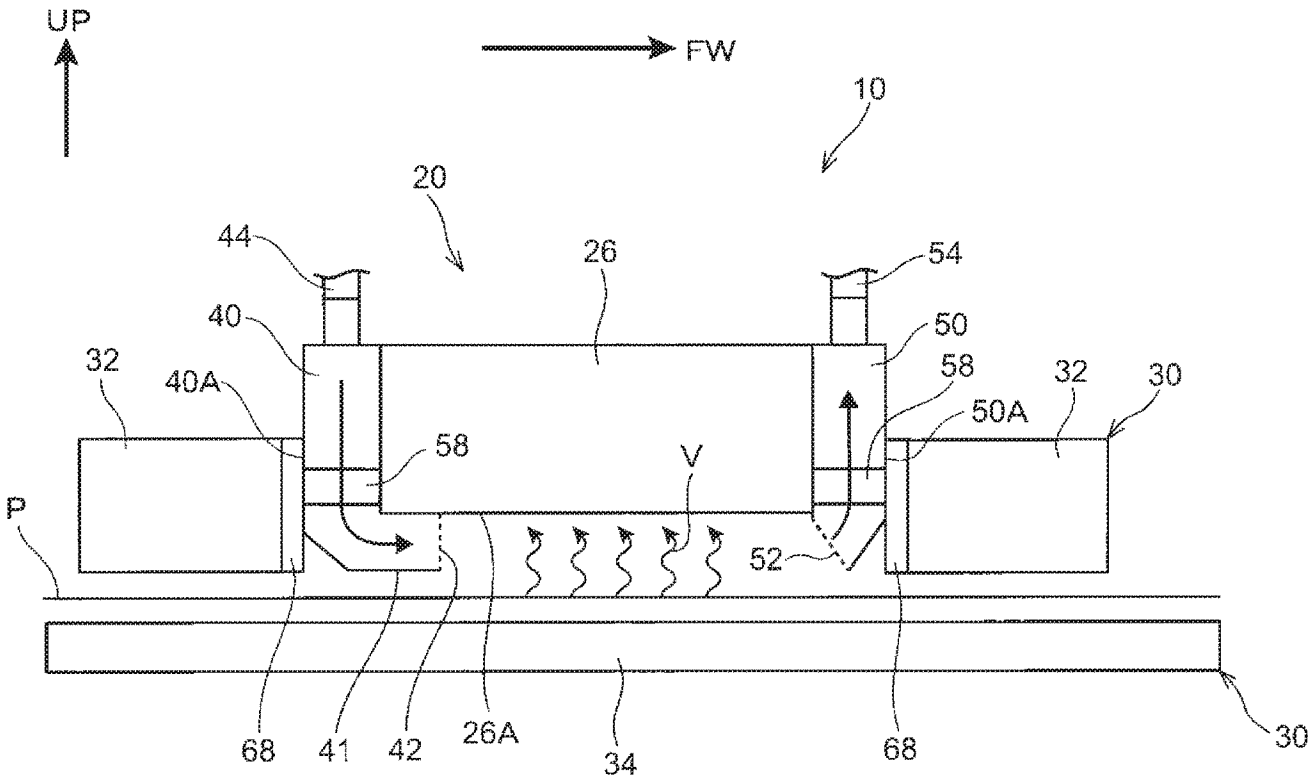
FIG. 7 is a side view illustrating the structure of an image forming part including a rubber heater and a heat insulating sheet of an inkjet recording apparatus according to a second embodiment.

As illustrated in FIG. 7, in the inkjet recording apparatus 10 of the second embodiment, a rubber heater 58 corresponding to an example of a heating part is wound in the vicinity of an inlet 52 of a vent duct 50. Owing to this rubber heater 58, the inlet 52 of the vent duct 50 is heated to a temperature of, for example, 30° C. or more, and preferably 40° C. or more, so that dew condensation is inhibited or prevented from occurring in the inlet 52.

Besides, the inkjet recording apparatus 10 of the second embodiment is configured so that the temperature of air blown through an outlet 42 of a supply duct 40 can be higher than the temperature of the atmosphere. Specifically, a dehumidifying part 48 is provided with a heating unit (not illustrated), so that air sent by an air blower 46 can be dried by the dehumidifying part 48 as well as heated to a temperature of, for example, 30° C. or more, and preferably 40° C. or more.

As a result, the dew condensation is further inhibited or prevented from occurring in the inlet 52 of the vent duct 50, and in addition, the drying of the air blown through the outlet 42 of the supply duct 40 is accelerated. Incidentally, the rubber heater 58 may be wound in the vicinity of the outlet 42 of the supply duct 40 similarly to the vent duct 50 as illustrated in FIG. 7 so as to heat the air blown through the outlet 42.

Besides, a heat insulating sheet 68 corresponding to an example of the heat insulating part may be provided on a wall 50A disposed at the conveyance downstream side of the vent duct 50 (i.e., between the vent duct 50 and a downstream portion of an upper shielding part 32). Thus, the temperature decrease of the vent duct 50 is suppressed. Similarly, the heat insulating sheet 68 corresponding to an example of the heat insulating part may be provided on a wall 40A disposed at the conveyance upstream side of the supply duct 40 (i.e., between the supply duct 40 and an upstream portion of the upper shielding part 32). Thus, the temperature decrease of the supply duct 40 is suppressed.

Third Embodiment

An inkjet recording apparatus 10 according to a third embodiment of the present invention will now be described. It is noted that like reference signs are used to refer to like elements used in the first and second embodiments, so as to omit the detailed description (including the common effects) .

Figure 8:
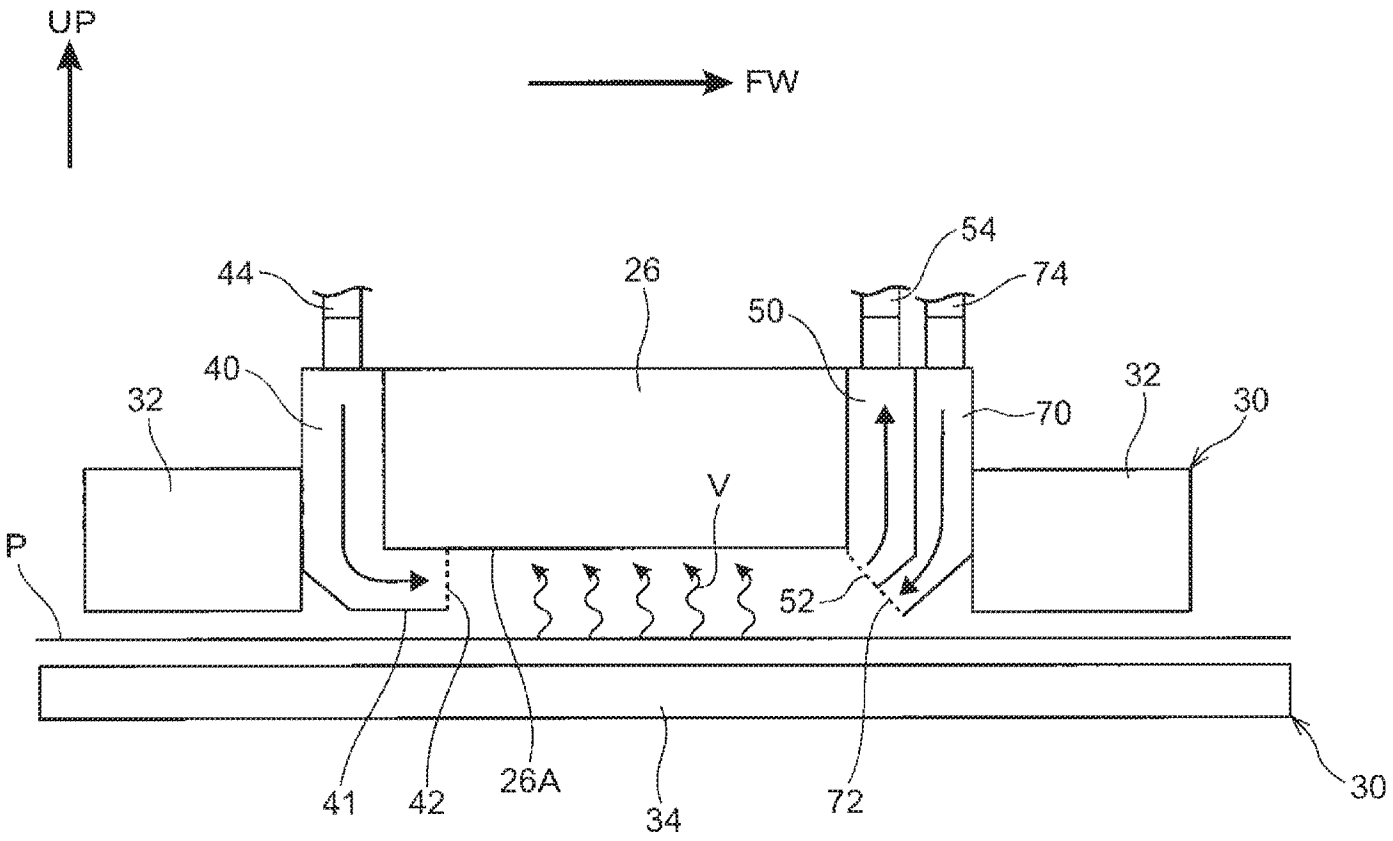
FIG. 8 is a side view illustrating the structure of an image forming part including a blow duct of an inkjet recording apparatus according to a third embodiment.

As illustrated in FIG. 8, in the inkjet recording apparatus 10 of the third embodiment, a blow duct 70 corresponding to an example of a blowing part for sending, to an upper surface of a continuous paper P, air flowing toward the conveyance upstream side is integrally provided at the conveyance downstream side of a vent duct 50. More specifically, an air outlet 72 of the blow duct 70 is formed in the shape of a rectangular opening opened toward the conveyance upstream side, and is integrally provided below an inlet 52 of the vent duct 50 with substantially the same width as the inlet 52.

Besides, one end of a flexible tube 74 is connected in a substantially center of an upper end portion of the blow duct 70, and the other end of the flexible tube 74 is connected to an air blower not illustrated but provided separately from an air blower 46. When this air blower is driven, breeze is blown through the air outlet 72 of the blow duct 70.

Thus, an air flow flowing toward the conveyance upstream side is formed below an air flow flowing toward the conveyance downstream side formed by the supply duct 40 and the vent duct 50 (and above an upper surface of continuous paper P). Owing to this air flow flowing toward the conveyance upstream side, water vapor V staying on the upper surface of the continuous paper P is forcedly caused to come up therefrom.

Accordingly, as compared with a case where the blow duct 70 is not provided, the water vapor V staying on the upper surface of the continuous paper P is efficiently vented by the air flow flowing toward the conveyance downstream side formed by the supply duct 40 and the vent duct 50, and hence, dew condensation is inhibited or prevented from occurring in a lower surface 26A of an irradiation part 26 or the like.

The inkjet recording apparatuses 10 according to the exemplary embodiments of the present invention have been described so far with reference to the accompanying drawings, and it is noted that the inkjet recording apparatuses 10 of the embodiments are not limited to those illustrated in the drawings but can be appropriately changed or modified within the scope of the present invention. For example, the recording medium is not limited to the continuous paper P but may be cut paper (plain paper).

Besides, the inkjet recording apparatus 10 of each embodiment is a full color inkjet recording apparatus, but it may be a monochrome inkjet recording apparatus. In this case, the recording apparatus includes the inkjet recording head 22 of black (K) alone as illustrated in FIG. 2. Besides, the inkjet recording apparatus 10 of each embodiment may be provided with merely one chamber 12 to perform the printing on merely one surface of the recording medium.

Furthermore, the irradiation part 26 is not limited in its position at the downstream side of the inkjet recording head 22 of black (K), but may be provided at the downstream side of each of the inkjet recording heads 22 of cyan (C), magenta (M) and yellow (Y). Besides, the order of the colors is not limited to black (K), cyan (C), magenta (M) and yellow (Y).

Moreover, the holding member 24 may be provided integrally with the upper shielding part 32. In other words, the inkjet recording head 22 is not limited to the structure in which it is movable in the vertical and horizontal directions independently of the irradiation part 26, but may be movable in the vertical and horizontal directions together with the irradiation part 26. In addition, the heating part of the second embodiment is not limited to the rubber heater 58.

Furthermore, in the third embodiment, the blow duct 70 may be connected to the air blower 46 as long as the flow rate of the blow duct 70 can be adjustable at the side of the blow duct 70 so that the breeze can be blown through the air outlet 72 of the blow duct 70. In this case, there is no need to provide another air blower separately from the air blower 46, and hence the increase of the production cost can be suppressed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A droplet ejection apparatus, comprising:

a droplet ejection bead that ejects a droplet onto a recording medium;

an irradiation part that is disposed at a downstream side, in a conveyance direction of the recording medium, of the droplet ejection head, and irradiates the recording medium with infrared laser light for evaporating a water content of a droplet landed on the recording medium;

a supply part that is disposed at an upstream side, in the conveyance direction of the recording medium, of the irradiation part and at the downstream side, in the conveyance direction of the recording medium, of the droplet ejection head, includes a rectifying part disposed along the conveyance direction of the recording medium, and causes the rectifying part to supply, above the recording medium, air toward the downstream side in the conveyance direction of the recording medium; and a vent part that is disposed at the downstream side, in the conveyance direction of the recording medium, of the irradiation part, and vents at least a part of air flown above the recording medium toward the downstream side in the conveyance direction of the recording medium.

2. The droplet ejection apparatus according to claim 1, further comprising a floating detection part that detects floating of the recording medium in a position opposing the irradiation part.

3. The droplet ejection apparatus according to claim 1, further comprising a pressure detection part that detects a pressure in a space disposed between the irradiation part and the recording medium.

4. The droplet ejection apparatus according to claim 1, wherein the vent part is provided with a heating part.

5. The droplet ejection apparatus according to claim 4, wherein the vent part is provided with a heat insulating part.

6. The droplet ejection apparatus according to claim 1, wherein a temperature of the air supplied from the supply part is set to be higher than a temperature of the atmosphere.

7. The droplet ejection apparatus according to claim 6, wherein the supply part is provided with a heat insulating part.

8. The droplet ejection apparatus according to claim 1, further comprising a blowing part that is disposed at the downstream side, in the conveyance direction of the recording medium, of the vent part, and sends, to an upper surface of the recording medium, air flowing toward the upstream side in the conveyance direction of the recording medium.

* * * * *